US005088606A

United States Patent [19]

Boas

[11] Patent Number: 5,088,606

[45] Date of Patent: Feb. 18, 1992

[54] ELONGATE DISPLAY PRONG

[75] Inventor: Barry Boas, Hertfordshire, United Kingdom

[73] Assignee: Boas Investments Limited, Finchley, England

[21] Appl. No.: 435,473

[22] Filed: Nov. 29, 1989

[30] Foreign Application Priority Data

Jun. 5, 1987 [GB] United Kingdom ..... 8713196

[51] Int. Cl.[5] ..... A47F 7/00

[52] U.S. Cl. ..... 211/571; 248/220.3

[58] Field of Search ..... 248/220.3, 220.4, 221.1, 248/221.2; 40/642, 655, 622, 657; 211/57.1, 54.1, 59.1, 59.3

[56] References Cited

U.S. PATENT DOCUMENTS

| | | | |
|---|---|---|---|
| 2,856,713 | 10/1950 | Mosca | 40/642 X |
| 3,483,995 | 12/1969 | Larson | 248/220.4 X |
| 3,534,864 | 10/1970 | Larson | 248/220.4 X |
| 3,912,084 | 10/1975 | Valulis | 248/220.4 |
| 4,039,131 | 8/1977 | Perrault et al. | 248/221.1 X |
| 4,066,169 | 1/1978 | Hochman | 211/57.1 |
| 4,463,510 | 8/1984 | Windish | 211/57.1 X |
| 4,474,300 | 10/1984 | Entis | 211/59.1 X |
| 4,583,308 | 4/1986 | Taub | 40/642 X |
| 4,665,639 | 5/1987 | Fast | 211/59.1 X |
| 4,754,563 | 7/1988 | Fast | 40/657 X |
| 4,779,367 | 10/1988 | Fast | 40/657 |

FOREIGN PATENT DOCUMENTS

| | | | |
|---|---|---|---|
| 2215563 | 10/1973 | Fed. Rep. of Germany | 211/59.1 |
| 2447032 | 4/1976 | Fed. Rep. of Germany | 211/54.1 |
| 6414539 | 9/1910 | France | 40/642 |
| 2585549 | 2/1987 | France | 40/642 |
| 2176661 | 12/1986 | United Kingdom | 40/642 |

*Primary Examiner*—Alvin C. Chin-Shue
*Assistant Examiner*—Sarah A. Lechok
*Attorney, Agent, or Firm*—Nixon & Vanderhye

[57] ABSTRACT

An elongate display prong for the display of articles in shops or the like includes a generally horizontal portion bent at an elbow to have an end portion angled for location into a standard peg board bracket. An end element is releasably attached to the other end of the arm. The end element pivotally mounts a flap member. The flap member and arm can be inserted through a correspondingly sized aperture formed in packaging of an article. The arm includes outer channels flanking an inner channel to reinforce the elongate arm. The channel includes a plurality of apertures providing push fit location for a display member and also a push fit location for a stock limiting element which restricts the length of the arm onto which articles can be hung.

12 Claims, 3 Drawing Sheets

ELONGATE DISPLAY PRONG

BACKGROUND OF THE INVENTION

1. Field of the Invention

This invention relates to an elongate display prong for the display of articles in shops or the like.

2. Description of Related Prior Art

UK-A-2149179 describes a display prong comprising an elongate arm having a predetermined cross-section for passing through a correspondingly sized aperture formed in the packaging of an article. At one end of the arm, there is provided an attachment means for attaching the display prong to a display apparatus. The other end of the arm is provided with a flap member movable between the display position and a loading position whereby the flap member and the elongate arm can pass through the aperture in the packaging of the article.

One of the disadvantages associated with such display prongs is the difficulty in high-lighting the articles available on the prong. Hitherto, it has been necessary to provide signs on the display apparatus to which the prong is attached. Such signs can comprise, for example, SALE, NEW LINES, SPECIAL OFFER, REDUCED. Another problem associated with such display prongs is their inability to mount many articles. Although a longer prong can be produced, it is likely to be rather fragile and also although a large number of articles can be mounted thereon initially, when fewer articles are located thereon, the articles will slop about on the prong increasing the likelihood of breakage of the prong.

SUMMARY OF THE INVENTION

It is an object of the present invention to provide an improved display prong.

According to one aspect of the invention there is provided a display prong comprising an elongate arm having a predetermined cross section for passing through a correspondingly sized aperture formed in packaging of an article, the arm being provided at one end with mounting means for mounting the prong to a display apparatus and the other end of the arm having restricting means for preventing accidental removal of the article from the prong, characterised in that the arm has interposed therebetween releasable attachment means whereby additional elements can be releasably mounted to the arm, and the restricting means is slidably detachable from the arm.

In this way, it is possible to attach, for example, a display card holder above the prong, in use, so that an appropriate display card can be allocated to the articles on the display prong. Alternatively, a stock limiter can be attached underneath the display prong, in use, so as to limit movement of the articles along the elongate arm.

Conveniently, the elongate arm has an inner channel section located between outer channel sections which define the width of the arm, the orientation of the inner section being opposite to the outer section. This structure for the arm produces a reinforced arm so that the likelihood of breaking off of the prong in use is reduced relative to the prior art. Conveniently, the elongate arm is formed from metal and the length of the arm is greater than five times the width of the arm.

In a preferred embodiment of the invention, the releasable attachment means comprises a push-fit mounting for receiving reciprocal push-fit members located on a display card or a stock limiter. The push-fit means allows simple and convenient attachment or removal of the display card or stock limiter from the arm. Preferably, the push-fit means comprises a plurality of apertures located along the inner channel section of the arm.

In another preferred embodiment of the invention, the restricting means has a flap member located thereon movable between a display position and a loading position whereby the flap member and the elongate arm can pass through said aperture. The restricting means may include push-fit means for locating with reciprocal push-fit means provided on the arm.

In accordance with another aspect of this invention, there is provided a kit of parts comprising a display prong as hereinbefore defined, a display card having means for attachment to the attachment means of the prong, and a limiting means for limiting movement of articles on the arm, the limiting means having means for attachment to the attachment means of the prong.

BRIEF DESCRIPTION OF THE DRAWINGS

Examples of the present invention will now be described with reference to the accompanying drawings, in which.

DESCRIPTION OF THE PREFERRED EMBODIMENT

Figure 1:
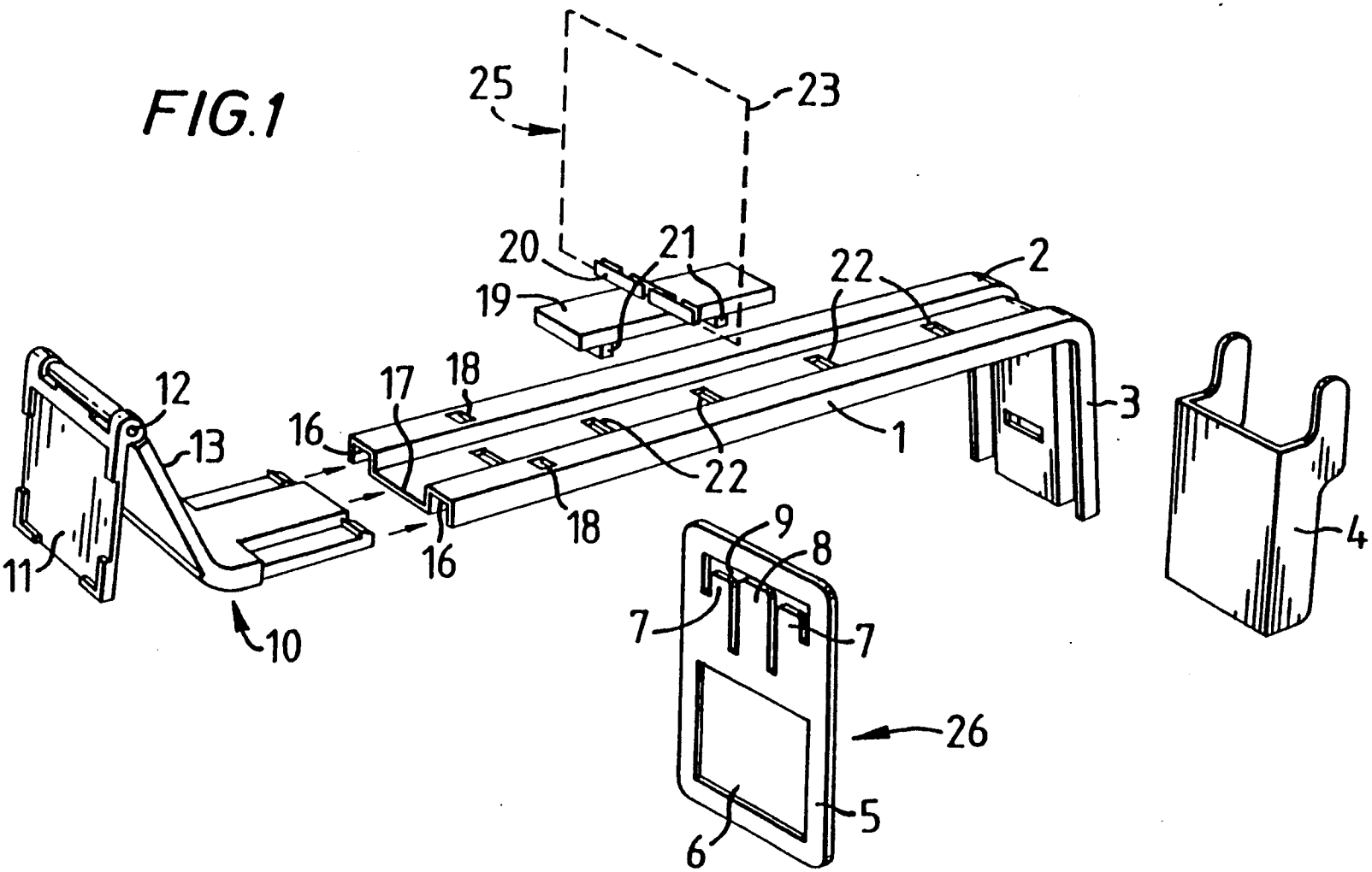
FIG. 1 illustrates a display prong embodying the present invention.
Figure 3:
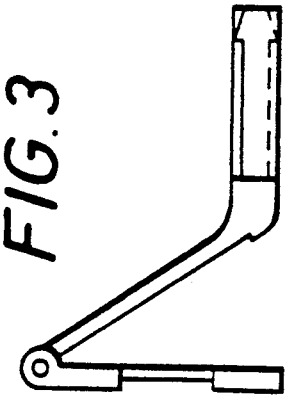
FIG. 3 illustrates a side view of the end element shown in FIG. 2.

Referring to FIG. 1, an elongate arm 1 comprises a generally horizontal portion bent at an elbow 2 to have an end portion 3 angled for location into a standard peg board bracket 4 which can locate into peg holes in a display board. Thus, the elongate arm is mounted in the bracket 4 so as to present a horizontally extending elongate arm. As can be seen from FIG. 1, the elongate arm has a central U-shaped channel section 17 spaced between inverted U-shaped channel sections 16. This produces a very strong elongate arm so that the length thereof can be extended relative to the prior art.

Figure 2:
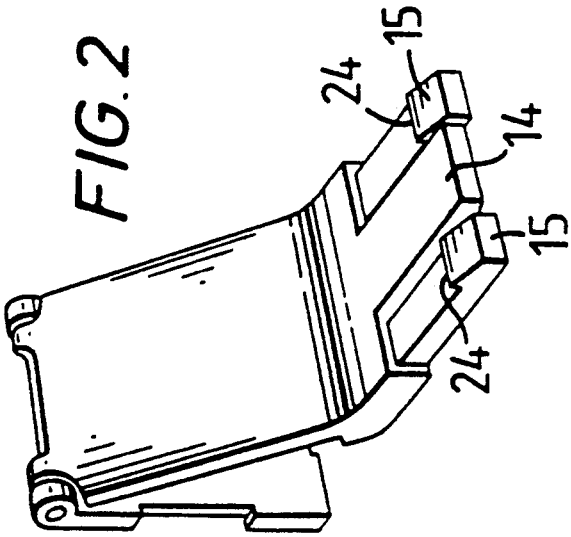
FIG. 2 illustrates an oblique perspective view of the end element as shown in FIG. 1.

An end element generally identified by numeral 10 comprises a central stud member 14 shown in FIG. 2 interposed between prongs 15 having up-turned hooks 24. The stud member 14 and prongs 15 extend upwardly as illustrated to a body portion 13 which has a pair of pivot points 12 on either side thereof for pivotally attaching a flap member 11. The angle relative to arm 1 at which portion 13 extends can be selected as required. The end element 10 is inserted into the end of the elongate arm so that the stud member 14 enters U-shaped channel 17 and the prong members 15 enter inverted U-shaped channel 16 so that the up-turned hooks 24 engage in respective apertures 18 provided in each channel 16. In this way, the end element 10 can be releasably and slidably located to the arm 1. It will be appreciated that the prongs 15 can compromise stud members whereas the member 14 can incorporate a down-turned hook 24 to engage in an aperture 22 pivoted on the base of channel 17. The dimensions of the end element are chosen so as to be able to pass through an appropriate aperture of, say, a product to be hung on the prong.

A display member identified generally at numeral 25 comprises a base element 19 having a width arranged to fit into the channel 17. A pair of stud members 21 extend downwardly on the underside of the base element 19 and can be located in apertures 22 formed in the channel 17. The studs 21 and apertures 22 can be formed to be either a push-fit location or a snap-fit location. A card holding element 20 is provided on the upper surface of the base element 19 for holding a display card 23 displaying particular information, for example the fact that the articles on the display prong are sale articles, reduced articles or a new line. Thus, a display card can be mounted to the prong at different positions along the arm length.

A stock limiting element generally identified by numeral 26 comprises an oblong card having an elongate aperture 9 parallel to the shorter edge of the card. The aperture 9 is sized so that the end element 10 and the elongate arm 1 can pass therethrough. As shown in FIG. 1, a pair of guides 7 are formed at either side of a central locating pin 8 which together define one edge of the aperture 9. When the stock limiter is passed over the end element 10, the guides 7 locate in the channels 16 until such point when the central pin 8 can enter one of the apertures 22. Once in this position, the limiting element defines the rearmost position to which articles placed on the display prong can pass. An aperture 6 in the limiting element is provided to save on raw materials in production of the stock limiter. Thus, movement of articles on the arm is restricted to a shorter length of the arm, that is to say between end element 10 and limiting element 26.

Figure 6:
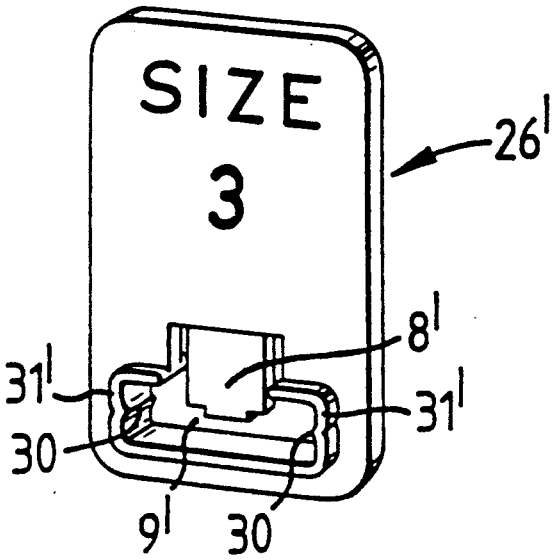
FIG. 6 illustrates a dual display and stock limiting member.

FIG. 6 illustrates an alternative stock limiting element 26' which also doubles up as a display member equivalent to that shown in FIG. 1. The element 26' is similar to that shown in FIG. 1 except that the aperture 6 is not formed, so that instead display information can be provided thereon. An elongate apperture 9' is provided in the oblong card parallel to the short edge thereof. A central locating pin 8' extends into the aperture so that the aperture is generally U-shaped. The lower side sections of the aperture 9 include a respective pair of indentations 30 and 31' the function of which will be explained hereinafter. When the element 26' shown in FIG. 6 is inserted over the end element 10 and onto the elongate arm 1 in order to function as a display member, the member 26' slides along until the locating pin 8' locates with one of the apertures 22. When locating in the aperture, the member 26' drops slightly relative to the arm 1 so that the side pieces of the channel 16 engage in the upper indentation 31' on the card 26'. When it is required to employ the member 26' as a stock limiting element, the member 26' is inverted and passed over the end element 10 and onto the arm 1. Eventually, the locating pin 8' engages with an aperture 22 and in so doing drops slightly so that the channels 16 engages in the other of the indentations 30 since the member 26' has been inverted relative to that shown in FIG. 6.

Figure 4:
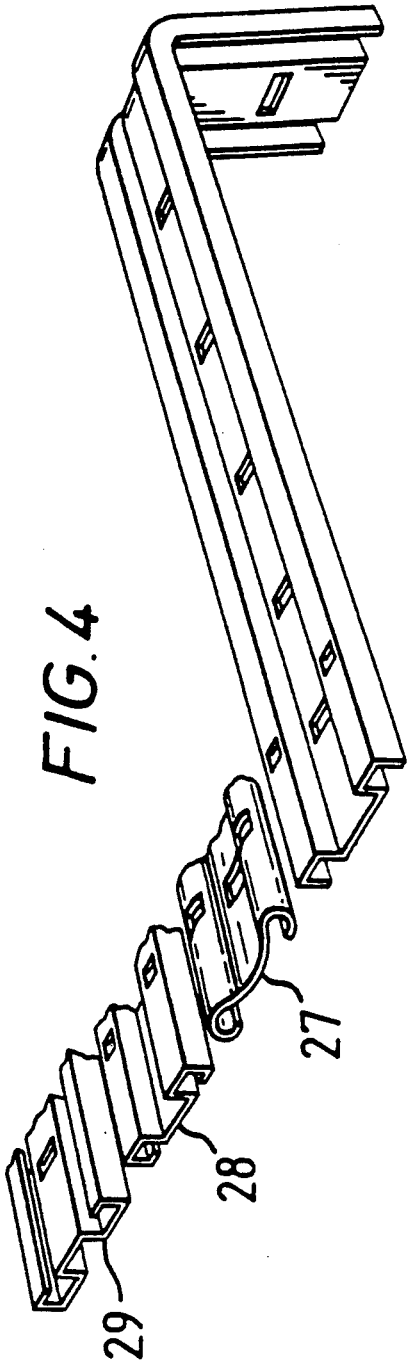
FIG. 4 illustrates alternative cross-sections for the elongate arm.

Referring to FIG. 4, it will be apparent that the structure of the elongate arm can take many forms. For example, the channels 16 and 17 of FIG. 1 can take a more rounded form as illustrated at numeral 27 in FIG. 4 or alternatively the channel 16 can include an overturn lip 28 as shown in FIG. 4. Naturally, it is possible for the channel 17 shown in FIG. 1 to be an inverted U-shaped channel section and the channel 16 to be an U-shaped channel section as shown at numeral 29 in FIG. 4.

Although the various cross-sections of the elongate arms shown in FIG. 4 give the elongate arm added strength, the arm 1 is preferably produced from metal sheet rather than plastics material. In this way, it has been found that strong display prongs can be produced which have a length of at least five times the width of the arm.

Figure 5:
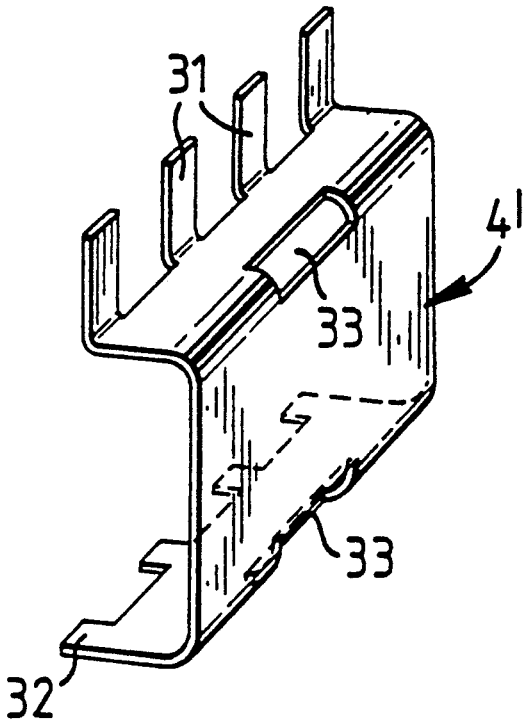
FIG. 5 illustrates an alternative peg board bracket for receiving the display prong.

It will be apparent that the present invention embodies various modifications and alterations, which will be apparent to a person skilled in the art. For example, FIG. 5 illustrates an alternative bracket 4' for fixing to peg holes in a display board. A planar rectangular sheet of metal has four pins 31 cut at one end and four pins 32 cut at the other end. The sheet is then bent into the form illustrated. The pins 31 are inserted horizontally into peg holes and the bracket is pivoted until the pins 32 can be inserted into lowe peg holes. It will be appreciated that the lower pins are not essential to hold the bracket 4 in place. A pair of apertures 33 are cut in the bracket to receive the end portion 3 of the arm 1.

I claim:

1. A display prong comprising an elongate arm having a predetermined cross section for passing through a correspondingly sized aperture formed in packaging for an articles, the arm being provided at one end with mounting means for mounting the prong to a display apparatus and the other end of the arm having restricting means for preventing accidental removal of the article from the prong, characterised in that the arm has interposed between said ends and forming an integral part thereof releasable attachment means whereby additional display prong device elements can be releasably mounted to the arm, and the restricting means is slidably detachable from the arm.

2. A prong as in claim 1 wherein the elongate arm has an inner channel section located between outer channel sections which define the width of the arm, the orientation of the inner channel section being opposite to the outer channel sections.

3. A prong as in claim 2 wherein the elongate arm is formed from metal and the length of the arm is greater than five times the width of the arm.

4. A prong as in claim 1 wherein said display prong device elements include a display card or a stock limiter and the releasable attachment means comprises a push fit mounting for receiving reciprocal push fit members located on a display card or a stock limiter.

5. A prong as in claim 4 wherein the push fit mounting comprises a plurality of apertures located along an inner channel section of the arm disposed between oppositely directed outer channel sections of the arm.

6. A prong as in claim 1 wherein the restricting means includes a flat member secured to said arm and movable, while secured to said arm, between a display position preventing movement of apertured articles from said prong and a loading position whereby the flat member and the elongate arm are aligned to receive the correspondingly sized aperture formed in packaging for an article to enable the packaged articles to be placed on said arm.

7. A prong as in claim 1 wherein the restricting means includes push fit means, for locating with reciprocal push fit means provided on the elongate arm.

8. A kit of parts comprising a display prong as in claim 1, a display card having means for attachment to the attachment means of the prong, and a limiting means for limiting movement of articles on the arm, the limiting means having means for attachment to the releasable attachment means of the prong.

9. A display prong for displaying apertured articles therealong, said display prong comprising:

an elongated arm having longitudinally extending channels and adapted for mounting at one end to a support structure so as to extend outwardly therefrom and support apertured articles distributed therealong through their respective apertures;

an articles restriction member slidably detachably mounted to the other end of said arm; and at least one further structural member detachably mountable to said arm between its ends, said arm having a plurality of integral structures between its ends and along said arm for detachably mounting said structural member at selected longitudinal positions along said arm.

10. A display prong as in claim 9 wherein said further structural member includes a display card for carrying display information relating to said apertured articles.

11. A display prong as in claim 9 wherein said further structural member includes a stock limiter for restricting the location of said apertured articles to a selected portion of said elongated arm.

12. A display prong as in claim 9 wherein said article restriction member includes a rotatable flat section which can be rotated to permit or restrict passage of said apertured articles over said article restriction member onto and off said arm.

* * * * *